United States Patent [19]

Burwasser

[11] Patent Number: 4,528,242

[45] Date of Patent: Jul. 9, 1985

[54] INK JET RECORDING TRANSPARENCY

[75] Inventor: Herman Burwasser, Boonton, N.J.

[73] Assignee: Transcopy, Inc., New York, N.Y.

[21] Appl. No.: 591,602

[22] Filed: Mar. 20, 1984

[51] Int. Cl.[3] ..... B41M 5/00

[52] U.S. Cl. ..... 428/413; 346/1.1; 346/135.1; 400/126; 427/261; 428/195; 428/411.1; 428/480; 428/483; 428/500

[58] Field of Search ..... 346/1.1, 135.1; 400/126; 427/261, 288; 428/195, 207, 480, 483, 500, 522, 413, 411.1

[56] References Cited

U.S. PATENT DOCUMENTS 4,269,891 5/1981 Minagawa ..... 428/335
4,308,542 12/1981 Maekawa et al. ..... 346/1.1
4,371,582 2/1983 Sugiyama et al. ..... 428/341
4,474,850 10/1984 Burwasser ..... 428/331

*Primary Examiner*—Bruce H. Hess
*Attorney, Agent, or Firm*—Walter Katz

[57] ABSTRACT

An improved ink jet recording transparency is described herein which is capable of absorbing colored, aqueous-miscible inks to provide very high density images which are permanent and smear resistant. This transparency article includes a transparent resinous support and an improved coating which is clear and comprises a mixture of a carboxylated polymer or copolymer, having a molecular weight of about 50,000 to 1 million, and a polyalkylene glycol having an average molecular weight of about 5,000 to 25,000, preferably 15,000 to 25,000, the glycol being present in an amount of about 5% to 70%, preferably 10% to 25%, by weight of said polymer.

10 Claims, No Drawings

INK JET RECORDING TRANSPARENCY

BACKGROUND OF THE INVENTION

1. Field of the Invention

This invention relates to a recording sheet for use in an ink jet recording process, and, more particularly, to an improved transparency recording sheet in which images formed thereon from colored ink jets are of very high density and smear resistant.

2. Description of the Prior Art

Ink jet machines for high speed recording of information, e.g. from computer terminals, have become widely used in the art. Such machines are described in detail in U.S. Pat. Nos. 4,390,883; 4,390,886; and 4,392,141. Ink jet compositions suitable for use in such machines are described in U.S. Pat. Nos. 4,155,768; 4,176,361; 4,197,135; 4,395,287; 4,396,429; 4,409,039; and 4,409,040. Ink jet recording sheets for receiving such ink compositions are described in U.S. Pat. Nos. 3,889,270; 4,269,891; 4,308,542; 4,371,582 and 4,419,388. Generally, these patents are concerned with providing paper sheets on which ink jet recording can produce high quality copies. The use of ink jet printing for achieving high speed recording on plastic transparencies, however, has been largely unsuccessful, because a transparent polyester film support repels aqueous-miscible ink solutions. Accordingly, high density images which are smear resistant cannot be obtained on uncoated polyester film.

SUMMARY OF THE INVLNTION

Therefore, it is an object of this invention to provide an ink jet recording transparency which is capable of wetting and absorbing colored, aqueousmiscible inks to provide very high density images which are smear resistant under normal use.

This object and other objects of the invention are realized herein by the provision of an improved ink jet recording transparency which is capable of absorbing colored, aqueous-miscible inks to provide very high density images which are permanent and smear resistant. The transparency article includes a transparent resinous support and an improved coating which is clear and comprises a mixture of a carboxylated polymer or copolymer, having a molecular weight of about 50,000 to 1 million, and a polyalkylene glycol, having an average molecular weight of about 5,000 to 25,000, preferably 15,000 to 25,000, the glycol being present in an amount of about 5% to 70%, preferably 10% to 25%, by weight of said polymer.

DETAILED DESCRIPTION OF THE INVENTION

The ink jet recording transparency of the invention includes a transparent resin as the base, which is generally a thermoplastic film, such as a polyester (e.g. polyethylene terephthalate, such as Mylar 400PB made by duPont), polystyrene, polyvinyl chloride, polymethylmethacrylate, cellulose acetate and the like. The thickness of the resin film base is not restricted to any special range although usually it has a thickness of about 2 to 10 mils.

The coating formulation of the invention includes a polymer component which is preferably a carboxylated, high molecular weight polymer or copolymer, or salts thereof. Suitable polymers include carboxylated acrylic or methacrylic acid, and esters thereof; carboxylated vinyl acetates; and carboxylated styrenated acrylics. Preferably the molecular weight of the polymer or copolymer ranges from about 50,000 to 1 million. Such polymers provide a clear coating, which is an essential physical property of the recording member of this invention while being receptive to the ink so as to provide useful recorded images thereon.

The polymer may contain other substituents in addition to carboxyl groups, such as hydroxyl, ester or amino groups, as long as the wettability property of the polymer is retained, and its ionic nature is sufficient to absorb the dye component of the ink.

The carboxyl group of the polymer also may be reacted wholly or partially with a base, such as a high boiling organic amine or an inorganic hydroxide, if necessary, to increase its water solubility. Typical organic amines which may be used for this purpose include methanolamine, ethanolamine and di- and trimethyl and ethanolamine. Inorganic hydroxides include sodium hydroxide, potassium hydroxide and the like.

The polyalkylene glycol component of the coating composition of the present invention generally is a polyethylene glycol although other alkylene glycols may be used as well. Preferably such polyethylene glycols have an average molecular weight of about 5,000 to about 25,000. In the most preferred embodiment, wherein high image densities are obtained in an ink jet recording process, the polyethylene glycol compound is made up of two moles of polyethylene glycol of average molecular weight of 8,000 each, which are joined by an epoxide to form a glycol compound with an average molecular weight of 17,500. This glycol is available commercially as "20M" from Union Carbide Corp.

There is a suitable range of compositional amounts of polymer and glycol in the coating of the invention which will provide desirable image densities while retaining the necessary properties of smear resistance, uniformity, and image resolution, at high ink flow rates. This range suitably includes about 5% to 70% of the glycol by weight of the polymer, preferably about 10% to 25%, and optimally, about 20% of glycol by weight of polymer.

The thickness of the coatings used herein generally range from about 2–15 microns. Such thicknesses will accommodate dyes of varying concentrations which can be delivered to the transparency at high rates of delivery and with accompanying high dye absorbtivity into the coating.

The dyes used herein to form images on the coating are usually aqueous-miscible color index acid, direct and reactive dyes containing anionic sulfonic acid groups, and basic dyes which contain cationic sites. These dyes, with their polar substituents, upon contacting the carboxyl substituent of the coating layer, are rapidly locked onto the surface of the record member by ionic interaction, which enhances color density, while the ink solvent is rapidly eluted down into the remaining portions of the coating layer, where it can begin to dry.

To test the quality of the recording coating material, two methods were used. In the first method, an ink jet transparency was prepared containing the coating of the invention, and a series of colored inks were ejected vertically onto the transparency. The resultant colored image was observed with respect to its absorbancy or color density, degree of spreading, and rate of drying, which is measured by its smear resistance after a given period of time. In the second method, a commercial ink jet color copier was used and the same physical characteristics of the imaged transparency were observed and measured.

The following examples are given to illustrate the invention in greater detail.

EXAMPLE 1

25.0 g of a carboxylated polyvinyl acetate copolymer (National Starch NS-1300) was dissolved in 37.5 g of toluene and 87.5 g of isopropanol and 4.4 g (15%) of Carbowax 20M (Union Carbide), a polyethylene glycol having an average molecular weight of 17,500, was added to form a coating solution. The resulting solution was then coated onto a 4.0 mil transparent polyester film with a #13 wire bar and air dried. The coating was 8.0 microns thick.

To the coated polyester film was projected vertically Tektronix Corp. aqueous colored inks of cyan (JIW 2004) and yellow, (JIN 5003), simulating an ink jet recording process, to obtain a multicolor recording on the film. The applied inks were observed to flow smoothly on the film and to form well-defined colored lines which absorbed easily into the coating, dried rapidly and were smear resistant. The optical densities of the images formed were exceptionally high as compared to coated films without this glycol component.

EXAMPLE 2

The procedure of Example 1 was repeated except that 10.7 g (30%) of Carbowax 20M was included in the coating mixture. The results were comparable to that of Example 1 at a somewhat lower image density level.

EXAMPLE 3

The procedure of Example 1 was repeated except that 2.8 g, 1.8 g and 0.25 g of Carbowax 20M was included in the coating mixture. The density of the images was diminished with decreasing concentration of the glycol.

EXAMPLE 4

The procedures of Examples 1–3 were repeated except that Carbowax 8000 (average molecular weight of 8,000) was used in place of 20M at glycol concentrations up to 30%. The images formed were of comparable properties except at a lower image density than the image formed in Example 1.

EXAMPLE 5

The procedures of Examples 1–4 were repeated using Carbowax 1000 in place of 20M and 8,000. The image densities of the recorded ink jet images were unacceptably low.

EXAMPLE 6

The procedures of Examples 1–5 were repeated using equivalent amounts of carboxylated acrylic polymer (National Starch 78-3955). The results were comparable to the above examples with respect to image properties.

EXAMPLE 7

The films of Examples 1–4 and 6 were tested using Tektronix 4691 and 4695 color copiers. The colored inks used were made available by the manufacturer, and included cyan, yellow, red, green and blue colors. Excellent results were obtained with respect to image properties using these films.

Although the invention has been described with particular reference to certain preferred embodiments thereof, it will be understood that modifications and changes may be made which are within the skill of the art.

It is intended to be bound only by the following claims, in which what is claimed is:

1. An ink jet recording transparency capable of forming very high density images when an aqueous-miscible ink is jetted thereon consisting essentially of (a) a substantially transparent resinous support, and (b) a substantially clear coating thereon consisting essentially of (1) a carboxylated polymer or copolymer, or salts thereof, having a molecular weight of about 50,000 to 1 million, and (2) a polyalkylene glycol having an average molecular weight of about 5,000 to about 25,000, and being present in an amount of about 5% to about by weight of said polymer.

2. An ink jet recording transparency according to claim 1 wherein the average molecular weight of said glycol is about 8,000 to about 20,000.

3. An ink jet recording transparency according to claim 1 wherein said glycol has an average molecular weight of about 17,500 and is made up of 2 moles of a polyalkylene glycol joined with epoxide.

4. An ink jet recording transparency according to claim 1 wherein said glycol is present in an amount of about 10% to about 25% by weight of said polymer.

5. An ink jet recording transparency according to claim 1 wherein said glycol is present in an amount of about 20% by weight of said polymer.

6. An ink jet recording transparency according to claim 1 wherein said carboxylated polymer is selected from a carboxylated acrylic or methacrylic polymer; a carboxylated vinyl acetate polymer and a carboxylated styrenated acrylic polymer having a molecular weight of about 50,000 to 1 million.

7. An ink jet recording transparency according to claim 1 wherein said polymer is a carboxylated acrylic polymer.

8. An ink jet recording transparency according to claim 1 wherein said polymer is a carboxylated vinyl acetate polymer.

9. An ink jet recording transparency according to claim 1 wherein said polymer is a carboxylated styrenated acrylic polymer.

10. An ink jet recording transparency according to claim 1 consisting essentially of a transparent polyester film support, and a clear coating thereon consisting essentially of a carboxylated acrylic or methacrylic polymer or copolymer, a carboxylated polyvinyl acetate, a carboxylated styrenated acrylic, having a molecular weight of about 50,000 to 1 million, and a polyalkylene glycol having an average molecular weight of about 5,000 to about 25,000, and being present in an amount of about 5% to about 70% by weight of said polymer.

* * * * *